US011226592B2

(12) United States Patent
Kaelin et al.

(10) Patent No.: US 11,226,592 B2
(45) Date of Patent: Jan. 18, 2022

(54) REGULATOR KEY

(71) Applicant: ETA SA Manufacture Horlogere Suisse, Grenchen (CH)

(72) Inventors: Laurent Kaelin, Sonvilier (CH); Fabien Schlup, Moutier (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 476 days.

(21) Appl. No.: 16/316,285

(22) PCT Filed: Jul. 13, 2017

(86) PCT No.: PCT/EP2017/067772
§ 371 (c)(1),
(2) Date: Jan. 8, 2019

(87) PCT Pub. No.: WO2018/015277
PCT Pub. Date: Jan. 25, 2018

(65) Prior Publication Data

US 2020/0292992 A1 Sep. 17, 2020

(30) Foreign Application Priority Data

Jul. 20, 2016 (EP) ..... 16180431

(51) Int. Cl.
*G04B 18/02* (2006.01)
*G04B 17/32* (2006.01)

(52) U.S. Cl.
CPC ..... *G04B 18/026* (2013.01); *G04B 17/325* (2013.01)

(58) Field of Classification Search
CPC ..... G04B 18/026; G04B 17/325; G04B 18/02
See application file for complete search history.

(56) References Cited

U.S. PATENT DOCUMENTS

| | | | | |
|---|---|---|---|---|
| 4,083,179 | A * | 4/1978 | Giger | G04B 17/325 368/184 |
| 4,201,042 | A | 5/1980 | Visconti et al. | |
| 2007/0091729 | A1 | 4/2007 | Takahashi | |
| 2012/0176869 | A1 | 7/2012 | Gonthier | |

FOREIGN PATENT DOCUMENTS

| | | |
|---|---|---|
| EP | 2 474 871 A1 | 7/2012 |
| FR | 2 331 078 | 6/1977 |
| FR | 2 390 766 | 12/1978 |

OTHER PUBLICATIONS

International Search Report dated Sep. 28, 2017 in PCT/EP2017/067772 filed Jul. 13, 2017.
Office Action dated Nov. 16, 2020 in corresponding Chinese Patent Application No. 201780044385.3 (with English Translation), 12 pages.

* cited by examiner

*Primary Examiner* — Edwin A. Leon
*Assistant Examiner* — Jason M Collins
(74) *Attorney, Agent, or Firm* — Oblon, McClelland, Maier & Neustadt, L.L.P.

(57) ABSTRACT

A regulator key whose arms ensure clearance of a balance spring even in event of shocks.

8 Claims, 2 Drawing Sheets

A - A

B - B

REGULATOR KEY

FIELD OF THE INVENTION

The invention relates to a regulator key for ensuring the balance spring clearance even in the event of shocks.

BACKGROUND OF THE INVENTION

It is known in regulator systems to use a regulator provided with two pins or with a regulator key to adjust the active length of a balance spring. Further, these systems are sometimes provided with an anti-shock device prevent the balance spring from leaving the interstice between the pins or the regulator key when the movement is subjected to shocks.

However, current regulator systems provided with an anti-shock device are cumbersome and/or do not allow after sales intervention, for example, to change the balance spring.

SUMMARY OF THE INVENTION

It is an object of the present invention to overcome all or part of the aforementioned drawbacks by proposing a novel regulator key whose arms ensure the clearance of the balance spring even in the event of shocks yet remain compact.

To this end the invention relates to a regulator key for a timepiece movement including a base arranged to be attached to a regulator and carrying two arms arranged to limit the clearance of a balance spring, characterized in that the two arms project from the base parallel to each other leaving an interstice arranged to receive said balance spring, in that the two arms each include a projecting surface which decreases away from the base to limit the dimensions of the end of the key, and in that the arms each include a partially hollow central portion so that the free end of each arm forms a hook running alongside said interstice arranged for receiving said balance spring.

In accordance with other advantageous variants of the invention:

- the regulator key has an axis of symmetry passing through the centre of the base;
- the sides of the arms running alongside said interstice are substantially C-shaped;
- the sides of the arms running alongside said interstice are flat;
- the sides of the arms running alongside said interstice are parallel;
- the surfaces of the sides of the arms running alongside said interstice which face each other are substantially I-shaped.

Moreover, the invention relates to a timepiece movement comprising a sprung balance resonator and a regulator system for adjusting the active length of the balance spring, characterized in that the regulator system includes a regulator key according to any of the preceding claims.

BRIEF DESCRIPTION OF THE DRAWINGS

Other features and advantages will appear clearly from the following description, given by way of non-limiting illustration, with reference to the annexed drawings, in which.

DETAILED DESCRIPTION OF PREFERRED EMBODIMENTS

Figure 1:
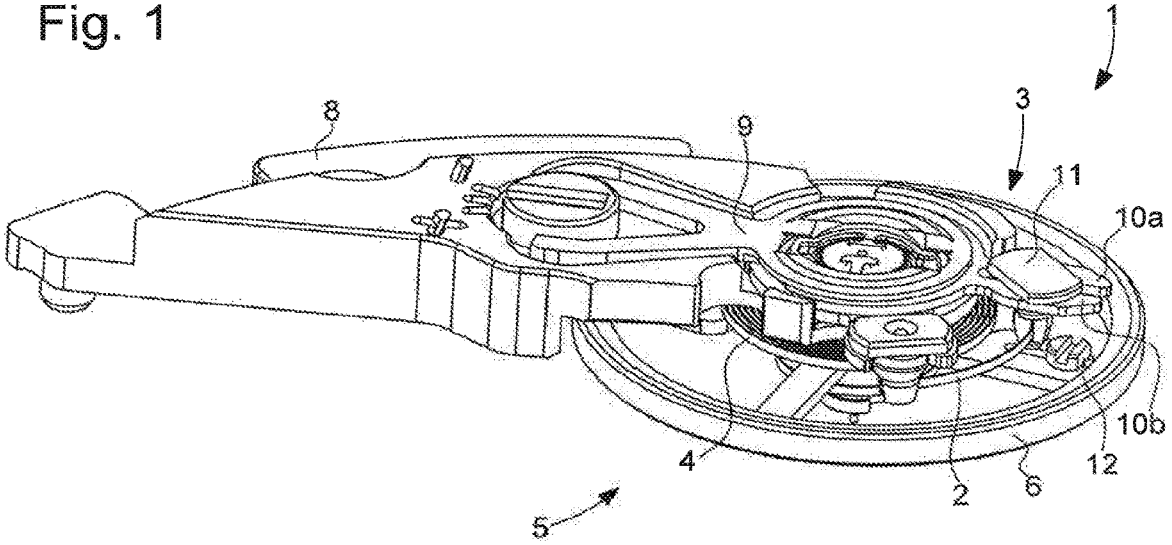
FIG. 1 is a partial, perspective representation of a movement according to the invention.
Figure 2:
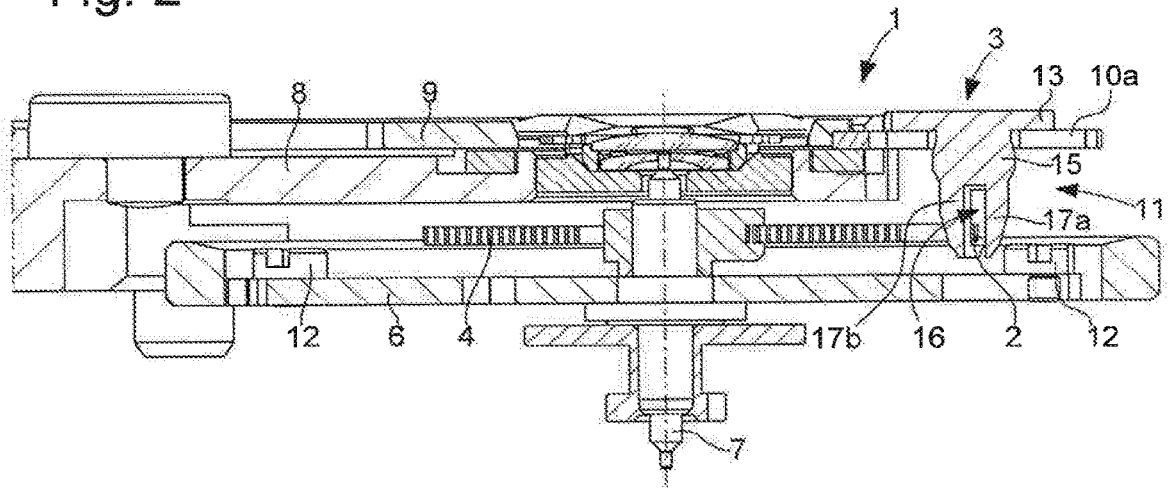
FIG. 2 is sectional representation of FIG. 1.
Figure 3:
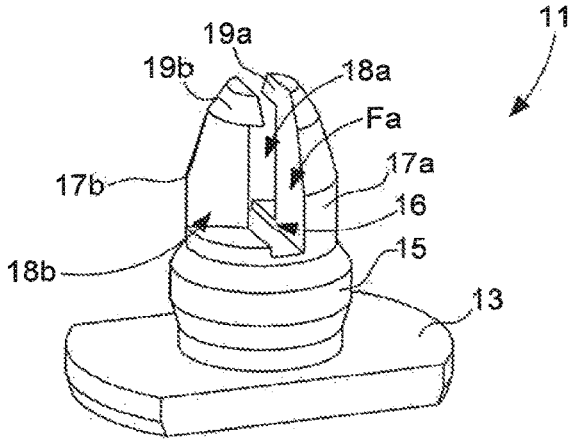
FIG. 3 is a perspective view of a regulator key according to the invention.
Figure 4:
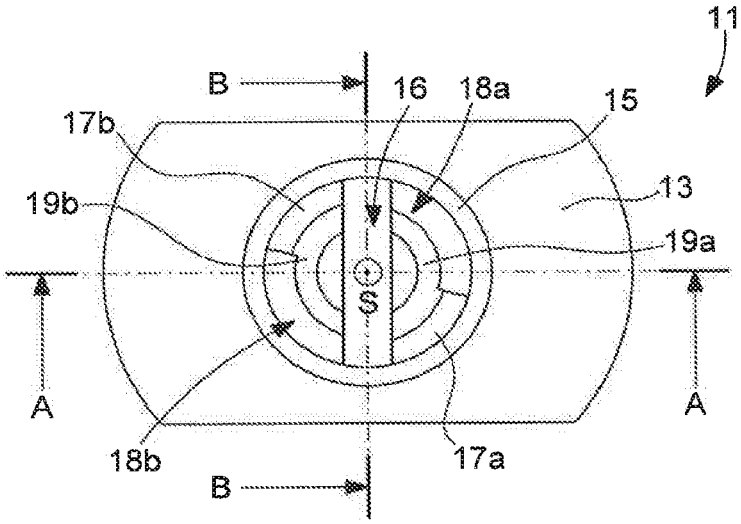
FIG. 4 is a top view of FIG. 3.
Figure 5:
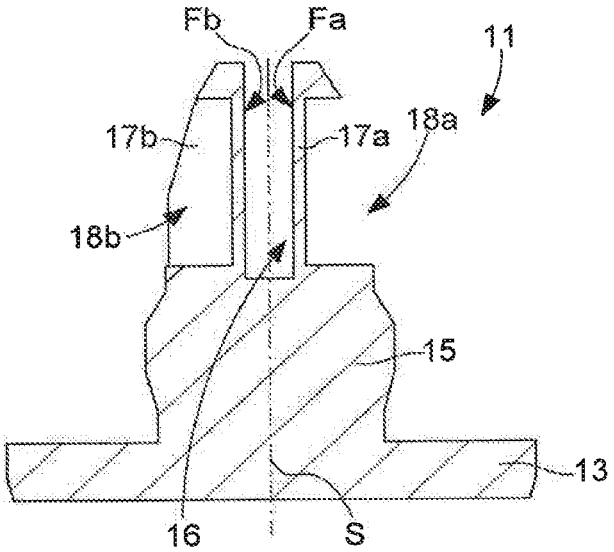
FIG. 5 is a view along section A-A of FIG. 4.

As illustrated in FIGS. 1 and 2, the invention relates to a regulator system 3 for a timepiece movement 1. In FIGS. 1 and 2, it can be seen that timepiece movement 1 further includes a resonator 5 of the balance 8/balance spring 4 type mounted on a staff 7 pivoting between a cock 8 and a plate (not represented).

Regulator system 3 is intended to adjust the active length of balance spring 4. It mainly comprises a regulator 9 and a regulator key 11. Regulator 9 is mounted in its central portion on cock 8 and supports regulator key 11 via two strips 10*a*, 10*b*. As more clearly shown in FIG. 2, the two strips 10*a*, 10*b* are used to lock regulator key 9 between its head 13 and its base 15.

It is therefore clear that, by rotating index 9 on cock 8, base 15 attached to index 9 will make it possible to adjust the relative position of regulator key 11 with respect to the length of outer coil 2 of balance spring 4 and, by rotating regulator key 11 between strips 10*a*, 10*b*, the clearance of outer coil 2 of balance spring 4 between arms 17*a*, 17*b* of regulator key 11.

As illustrated in FIGS. 3 to 6, the two arms 17*a*, 17*b* project from base 15 parallel to each other, leaving an interstice 16 arranged to receive balance spring 4, as seen in FIG. 2. Further, the two arms 17*a*, 17*b* each include a projecting surface which decreases away from base 15 in order to limit the dimensions of the end of regulator key 11. As seen clearly in FIG. 3, if they were joined, the two arms 17*a*, 17*b* would form an external surface similar to a truncated cone. An examination of FIG. 2 reveals that this shape of arms 17*a*, 17*b* offers a compactness that allows more spatial freedom for balance 6 such as, for example, at inertia blocks 12.

Further, arms 17*a*, 17*b* each include a partially hollow central portion 18*a*, 18*b* so that the free end of each arm forms a hook 19*a*, 19*b* running alongside interstice 16, i.e. not projecting into interstice 16.

An examination of FIGS. 3 to 6 reveals that regulator key 11 has an axis S of symmetry passing through the centre of base 15. This feature is particularly desirable to avoid having a direction of assembly of regulator key 11 between the two arms 10*a*, 10*b*.

Figure 6:
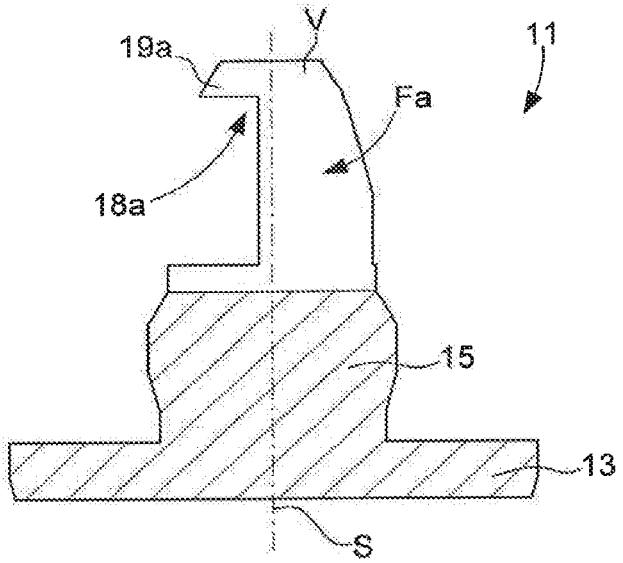
FIG. 6 is a view along section B-B of FIG. 4.

Further, this symmetry offers features specific to sides Fa, Fb of arms 17*a*, 17*b* running alongside interstice 16. Thus, as seen in FIG. 6, side Fa of arm 17*a* is substantially C-shaped or reverse C-shaped. Consequently, advantageously according to the invention, outer coil 2 of balance spring 4 will not only be able to be received in interstice 16, but also in partially hollow central portions 18*a*, 18*b* of arms 17*a*, 17*b*. It is clear therefore that the clearance of outer coil 2 of balance spring 4 between arms 17*a*, 17*b* of regulator key 11 will be provided by the banking of the vertical portion of the C or reverse C of sides Fa, Fb of arms 17*a*, 17*b* running alongside interstice 16.

Further, sides Fa, Fb of arms 17*a*, 17*b* running alongside interstice 16 are preferably flat and parallel. It is noted finally, by means of the grey portion of FIG. 6, that surfaces V of sides Fa, Fb of arms 17*a*, 17*b* running alongside interstice 16 which face each other are substantially I-shaped.

Advantageously according to the invention, by rotating regulator 9 on cock 8, these features make it possible to adjust the relative position of regulator key 11 with respect to the length of the outer coil 2 of balance spring 4, and by rotating regulator key 11 between strips 10*a*, 10*b*, to adjust the clearance of outer coil 2 of balance spring 4 between arms 17*a*, 17*b* of regulator key 11.

As seen in FIG. 1, when regulator key 11 is turned relative to strips 10*a*, 10*b*, outer coil 2 of balance spring 4 is trapped inside interstice 16 and partially hollow central portions 18*a*, 18*b* of arms 17*a*, 17*b*. Indeed, as the curvature of outer coil 2 of balance spring 4 extends into partially hollow central portions 18*a*, 18*b* of arms 17*a*, 17*b*, hooks 19*a*, 19*b* prevent balance spring 4 from leaving interstice 16 of regulator key 11, even when the movement is subjected to shocks.

However, it is still possible to release balance spring 4 again from regulator key 11, for example for an after sales intervention. It is sufficient to turn regulator key 11 so that sides Fa, Fb of arms 17*a*, 17*b* are parallel with respect to the height of outer coil 2 of balance spring 4 and then to remove balance spring 4 along interstice 16.

Of course, this invention is not limited to the illustrated example but is capable of various variants and modifications that will appear to those skilled in the art. In particular, regulator key 11 could be of different geometry to adapt to another type of balance spring and/or another type of balance and/or another type of regulator and/or another type of cock.

It is clear, for example, that depending on the thickness of a different balance spring, a greater or lesser distance may be desired between sides Fa, Fb of arms 17*a*, 17*b* or that, depending on the distance between a different regulator and a different balance spring, a greater or lesser length of arms 17*a*, 17*b* may be desired.

The invention claimed is:

1. A regulator key for a timepiece movement comprising:

a base configured to be attached to a regulator and carrying two arms configured to limit clearance of a balance spring, wherein the two arms project from the base parallel to each other, leaving an interstice configured to receive the balance spring, wherein the two arms each include a projecting surface which decreases in width along a length of the arm away from the base to limit dimensions of an end of the regulator key and the two arms each include a partially hollow central portion so that a free end of each arm forms a hook extending mainly parallel to the longitudinal direction of the interstice and running alongside the interstice configured to receive the balance spring, and wherein a portion of the projecting surface which decreases away from the base is located at a same position along a longitudinal axis of the regulator key as the partially hollow central portions.

2. A regulator key according to claim 1, wherein the two hooks extend in opposite directions.

3. A regulator key according to claim 1, wherein the regulator key has an axis of symmetry passing through the center of the base.

4. A regulator key according to claim 1, wherein the sides of the two arms running alongside the interstice are substantially C-shaped.

5. A regulator key according to claim 1, wherein the sides of the two arms running alongside the interstice are flat.

6. A regulator key according to claim 1, wherein the sides of the two arms running alongside the interstice are parallel.

7. A regulator key according to claim 1, wherein surfaces of the sides of the two arms running alongside the interstice, which face each other, are substantially I-shaped.

8. A timepiece movement comprising:

a resonator including a balance and balance spring; and a regulator system adjusting an active length of the balance spring;

wherein the regulator system includes a regulator key including a base configured to be attached to a regulator and carrying two arms configured to limit clearance of a balance spring, wherein the two arms project from the base parallel to each other, leaving an interstice configured to receive the balance spring;

wherein the two arms each include a projecting surface which decreases in width along a length of the arm away from the base to limit dimensions of an end of the regulator key and the two arms each include a partially hollow central portion so that a free end of each arm firms a hook extending mainly parallel to the longitudinal direction of the interstice and running alongside the interstice configured to receive the balance spring, and wherein a portion of the projecting surface which decreases away from the base is located at a same position along a longitudinal axis of the regulator key as the partially hollow central portions.

* * * * *